US011371371B1

(12) United States Patent
Sobanski et al.

(10) Patent No.: US 11,371,371 B1
(45) Date of Patent: Jun. 28, 2022

(54) VANE WITH PIN MOUNT AND ANTI-ROTATION BAFFLE

(71) Applicant: RAYTHEON TECHNOLOGIES CORPORATION, Farmington, CT (US)

(72) Inventors: Jon E. Sobanski, Glastonbury, CT (US); Howard J. Liles, Newington, CT (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 0 days.

(21) Appl. No.: 17/213,705

(22) Filed: Mar. 26, 2021

(51) Int. Cl.
*F01D 9/04* (2006.01)
*F01D 5/14* (2006.01)
*F01D 5/28* (2006.01)

(52) U.S. Cl.
CPC ..... *F01D 9/041* (2013.01); *F01D 5/147* (2013.01); *F01D 5/284* (2013.01); *F05D 2260/30* (2013.01)

(58) Field of Classification Search
CPC ..... F01D 5/147; F01D 9/041; F01D 5/284; F01D 5/18
See application file for complete search history.

(56) References Cited

U.S. PATENT DOCUMENTS 5,630,700 A 5/1997 Olsen et al.
6,164,903 A * 12/2000 Kouris ..... F01D 9/04 415/138
9,970,317 B2 * 5/2018 Freeman ..... F01D 25/005
10,822,973 B2 11/2020 Parvis et al.

* cited by examiner

*Primary Examiner* — Michael L Sehn
(74) *Attorney, Agent, or Firm* — Carlson, Gaskey & Olds, P.C.

(57) ABSTRACT

A vane arc segment includes an airfoil and a spar that has a spar platform adjacent a first fairing platform of the airfoil fairing and a spar leg that extends through a hollow airfoil section of the airfoil fairing. An end portion of the spar leg has a spar clevis mount. There is a support platform adjacent the second fairing platform that has first and second through-holes. The spar clevis mount protrudes from the support platform. There is a spar pin that extends through the spar clevis mount and locks the support platform to the spar leg. A baffle extends through the spar platform, through the hollow airfoil section, and through the second through-hole of the support platform. The baffle is secured in a joint to the support platform and thereby limits rotation of the support platform about the spar pin.

20 Claims, 7 Drawing Sheets

VANE WITH PIN MOUNT AND ANTI-ROTATION BAFFLE

BACKGROUND

A gas turbine engine typically includes a fan section, a compressor section, a combustor section and a turbine section. Air entering the compressor section is compressed and delivered into the combustion section where it is mixed with fuel and ignited to generate a high-speed exhaust gas flow. The high-speed exhaust gas flow expands through the turbine section to drive the compressor and the fan section. The compressor section may include low and high pressure compressors, and the turbine section may also include low and high pressure turbines.

Airfoils in the turbine section are typically formed of a superalloy and may include thermal barrier coatings to extend temperature capability and lifetime. Ceramic matrix composite ("CMC") materials are also being considered for airfoils. Among other attractive properties, CMCs have high temperature resistance. Despite this attribute, however, there are unique challenges to implementing CMCs in airfoils.

SUMMARY

A vane arc segment according to an example of the present disclosure includes an airfoil fairing that has first and second fairing platforms and a hollow airfoil section extending there between. A spar has a spar platform adjacent the first fairing platform and a spar leg that extends from the spar platform and through the hollow airfoil section. The spar leg has an end portion that is distal from the platform and that protrudes from the second fairing platform. The end portion has a spar clevis mount. A support platform is adjacent the second fairing platform. The support platform has first and second through-holes. The end portion of the spar leg extends through the first through-hole such that the spar clevis mount protrudes from the support platform. A spar pin extends through the spar clevis mount and locks the support platform to the spar leg such that the airfoil fairing is trapped between the spar platform and the support platform. A baffle extends through the spar platform, through the hollow airfoil section, and through the second through-hole of the support platform. The baffle is secured in a joint to the support platform and thereby limits rotation of the support platform about the spar pin.

In a further embodiment, the joint includes a baffle clevis mount on an end portion of the baffle that protrudes from the support platform and a baffle pin that that extends though the baffle clevis mount.

In a further embodiment, the baffle clevis mount includes first and second prongs that have respective pin holes that are coaxially aligned with each other, and the baffle pin is disposed in the pin holes.

In a further embodiment, the baffle includes forward and aft sides, and the baffle pin is offset toward either the forward side or the aft side.

In a further embodiment, the joint includes a weldment.

In a further embodiment, the joint includes a notch on an end portion of the baffle that protrudes from the support platform and a lock pin disposed in the notch.

In a further embodiment, the joint includes an external thread on an end portion of the baffle that protrudes from the support platform and a nut secured on the external thread.

In a further embodiment, the joint includes a clamp that has a set screw that is tightened against the baffle.

In a further embodiment, the joint includes an internal thread in an end portion of the baffle and a bolt secured in the internal thread.

In a further embodiment, the baffle includes a ledge that bears against the support platform.

In a further embodiment, the baffle is in tension.

In a further embodiment, the airfoil fairing is formed of ceramic.

A gas turbine engine according to an example of the present disclosure includes a compressor section, a combustor in fluid communication with the compressor section, and a turbine section in fluid communication with the combustor. The turbine section has vane arc segments disposed about a central axis of the gas turbine engine. Each of the vane arc segments includes an airfoil fairing that has first and second fairing platforms and a hollow airfoil section that extends there between. A spar has a spar platform adjacent the first fairing platform and a spar leg that extends from the spar platform and through the hollow airfoil section. The spar leg has an end portion that is distal from the platform and that protrudes from the second fairing platform. The end portion has a spar clevis mount. A support platform adjacent the second fairing platform has first and second through-holes. The end portion of the spar leg extends through the first through-hole such that the spar clevis mount protrudes from the support platform. A spar pin extends through the spar clevis mount and locks the support platform to the spar leg such that the airfoil fairing is trapped between the spar platform and the support platform. The support platform has a tendency to rotate about the spar pin under the aerodynamic loads received from the airfoil fairing. A baffle extends through the spar platform, through the hollow airfoil section, and through the second through-hole of the support platform. The baffle is secured in a joint to the support platform and thereby limits rotation of the support platform about the spar pin.

In a further embodiment, the joint includes a baffle clevis mount on an end portion of the baffle that protrudes from the support platform and a baffle pin that that extends though the baffle clevis mount.

In a further embodiment, the baffle clevis mount includes first and second prongs that have respective pin holes that are coaxially aligned with each other, and the baffle pin is disposed in the pin holes.

In a further embodiment, the baffle includes forward and aft sides, and the baffle pin is offset toward either the forward side or the aft side.

In a further embodiment, the joint includes a weldment.

In a further embodiment, the joint includes at least one of a notch on an end portion of the baffle that protrudes from the support platform and a lock pin disposed in the notch, an external thread on an end portion of the baffle that protrudes from the support platform and a nut secured on the external thread, a clamp that has a set screw that is tightened against the baffle, or an internal thread in an end portion of the baffle and a bolt secured in the internal thread.

In a further embodiment, the baffle is in tension.

In a further embodiment, the airfoil fairing is formed of ceramic.

The present disclosure may include any one or more of the individual features disclosed above and/or below alone or in any combination thereof

BRIEF DESCRIPTION OF THE DRAWINGS

The various features and advantages of the present disclosure will become apparent to those skilled in the art from the following detailed description. The drawings that accompany the detailed description can be briefly described as follows.

DETAILED DESCRIPTION

Figure 1:
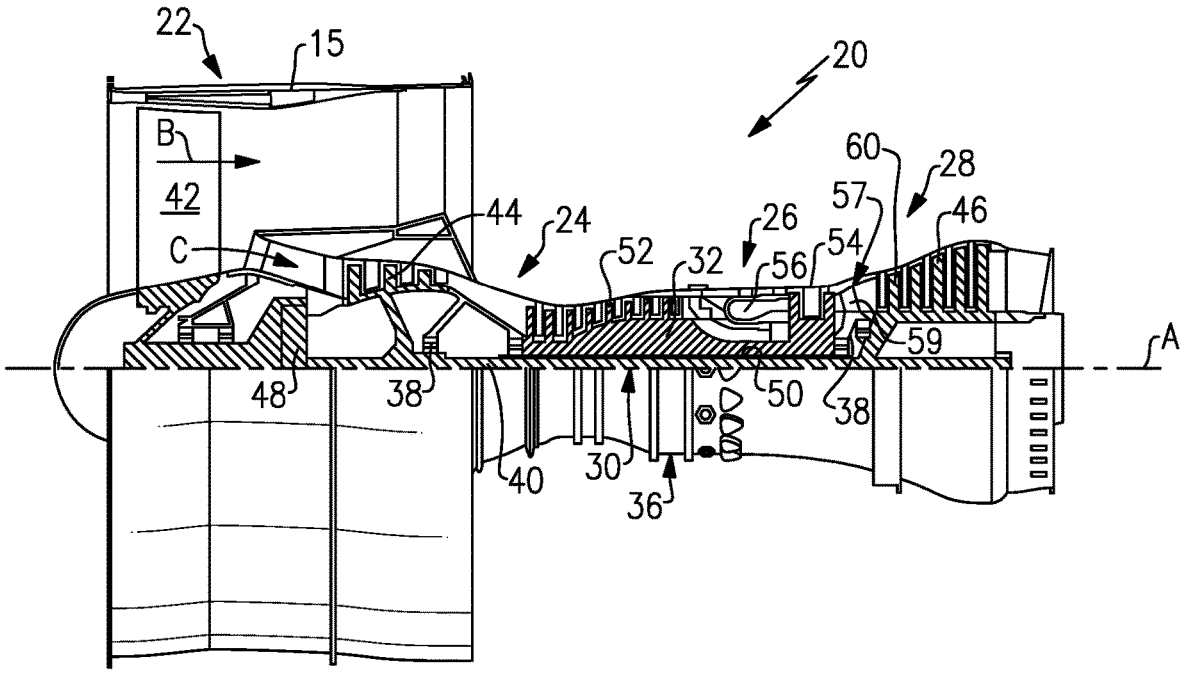
FIG. 1 illustrates a gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. The fan section 22 drives air along a bypass flow path B in a bypass duct defined within a housing 15 such as a fan case or nacelle, and also drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects, a first (or low) pressure compressor 44 and a first (or low) pressure turbine 46. The inner shaft 40 is connected to the fan 42 through a speed change mechanism, which in exemplary gas turbine engine 20 is illustrated as a geared architecture 48 to drive a fan 42 at a lower speed than the low speed spool 30. The high speed spool 32 includes an outer shaft 50 that interconnects a second (or high) pressure compressor 52 and a second (or high) pressure turbine 54. A combustor 56 is arranged in exemplary gas turbine 20 between the high pressure compressor 52 and the high pressure turbine 54. A mid-turbine frame 57 of the engine static structure 36 may be arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded through the high pressure turbine 54 and low pressure turbine 46. The mid-turbine frame 57 includes airfoils 59 which are in the core airflow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of the low pressure compressor, or aft of the combustor section 26 or even aft of turbine section 28, and fan 42 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1 and less than about 5:1. It should be understood, however, that the above parameters are only exemplary of one embodiment of a geared architecture engine and that the present invention is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet (10,668 meters). The flight condition of 0.8 Mach and 35,000 ft (10,668 meters), with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram}\ ^\circ\ \text{R})/(518.7^\circ\ \text{R})]^{0.5}$. The "Low corrected fan tip speed" as disclosed herein according to one non-limiting embodiment is less than about 1150 ft/second (350.5 meters/second).

Figure 2:
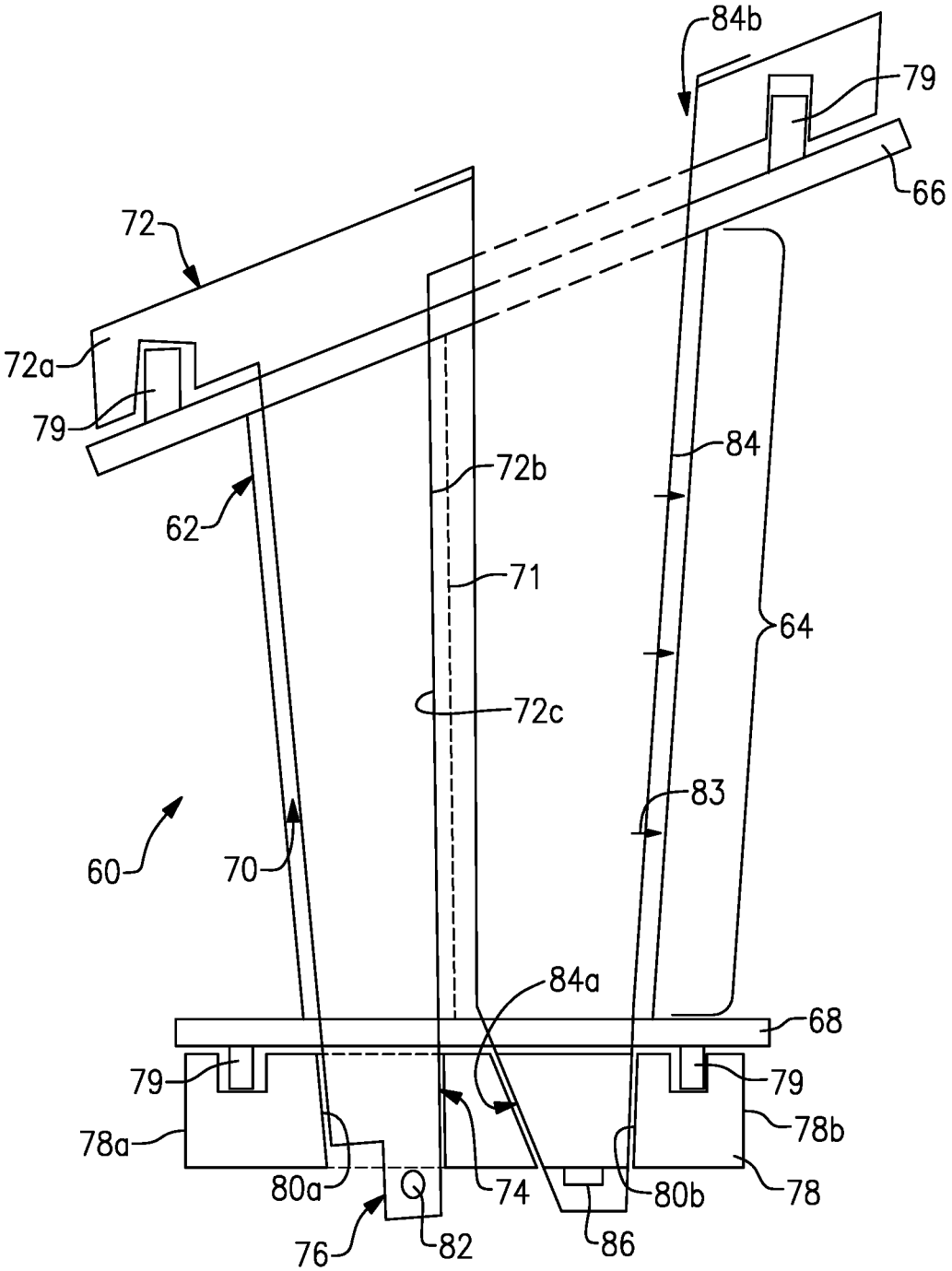
FIG. 2 illustrates a vane arc segment from the engine.

FIG. 2 illustrates a line representation of an example of a vane arc segment 60 from the turbine section 28 of the engine 20 (see also FIG. 1). It is to be understood that although the examples herein are discussed in context of a vane from the turbine section, the examples can be applied to other vanes that have support spars.

The vane arc segment 60 includes an airfoil 62 that is comprised of an airfoil section 64 and first and second platforms 66/68 between which the airfoil section 64 extends. The airfoil section 64 generally extends in a radial direction relative to the central engine axis A. The terms such as "inner" and "outer" refer to location with respect to the central engine axis A, i.e., radially inner or radially outer. Moreover, the terminology "first" and "second" used herein is to differentiate that there are two architecturally distinct components or features. It is to be further understood that the terms "first" and "second" are interchangeable in that a first component or feature could alternatively be termed as the second component or feature, and vice versa.

The airfoil fairing 62 is continuous in that the platforms 66/68 and airfoil section 64 constitute a unitary body. As an example, the airfoil fairings are formed of a ceramic matrix composite, an organic matrix composite (OMC), or a metal matrix composite (MMC). For instance, the ceramic matrix composite (CMC) is formed of ceramic fiber tows that are disposed in a ceramic matrix. The ceramic matrix composite may be, but is not limited to, a SiC/SiC ceramic matrix composite in which SiC fiber tows are disposed within a SiC matrix. Example organic matrix composites include, but are not limited to, glass fiber tows, carbon fiber tows, and/or aramid fiber tows disposed in a polymer matrix, such as epoxy. Example metal matrix composites include, but are not limited to, boron carbide fiber tows and/or alumina fiber tows disposed in a metal matrix, such as aluminum. A fiber tow is a bundle of filaments. As an example, a single tow may have several thousand filaments. The tows may be arranged in a fiber architecture, which refers to an ordered arrangement of the tows relative to one another, such as, but not limited to, a 2D woven ply or a 3D structure.

The airfoil section 64 circumscribes an interior through-cavity 70. The airfoil section 64 may have a single through-cavity 70, or the cavity 70 may be divided into forward and aft sub-cavities by one or more ribs 71. The vane arc segment 60 further includes a spar 72 that extends through the through-cavity 70 and mechanically supports the airfoil fairing 62. The spar 72 in this example includes a spar platform 72*a* and a spar leg 72*b* that extends from the spar platform 72*a* into the through-cavity 70. Although not shown, the spar platform 72*a* includes attachment features that secure it to a fixed support structure, such as an engine case.

The spar leg 72*b* defines an interior through-passage 72*c*. Cooling air, such as bleed air from the compressor section 24, is conveyed into and through the through-passage 72*c* of the spar 72. This cooling air is destined for a downstream cooling location, such as a tangential onboard injector (TOBI). Cooling air may also be provided into cavity 70 for cooling of the airfoil section 64.

The spar leg 72*b* has a distal end portion 74 that has a spar clevis mount 76. The end portion 74 of the spar leg 72*b* extends past the platform 68 of the airfoil fairing 62 so as to protrude from the airfoil fairing 62. There is a support platform 78 adjacent the platform 68 of the airfoil fairing 62. In this example, the support platform 78, the platform 68 of the airfoil fairing 62, or both may have support flanges 79 through which the airfoil fairing 62 may mechanically interface with the spar platform 72*a* and support platform 78.

The support platform 78 includes a first through-hole 80*a* through which the end portion 74 of the spar leg 72*b* extends such that the spar clevis mount 76 protrudes from the support platform 78. A pin 82 extends though the spar clevis mount 76. The pin 82 is wider than the through-hole 80*a*. The ends of the pin 82 thus abut the face of the support platform 78 and thereby prevent the spar leg 72*b* from being retracted into the through-hole 80*a*. The pin 82 thus locks the support platform 78 to the spar leg 72*b* such that the airfoil fairing 62 is mechanically trapped between the spar platform 72*a* and the support platform 78. The spar 72 may be formed of a relatively high temperature resistance, high strength material, such as a single crystal metal alloy (e.g., a single crystal nickel- or cobalt-alloy).

Figure 3:
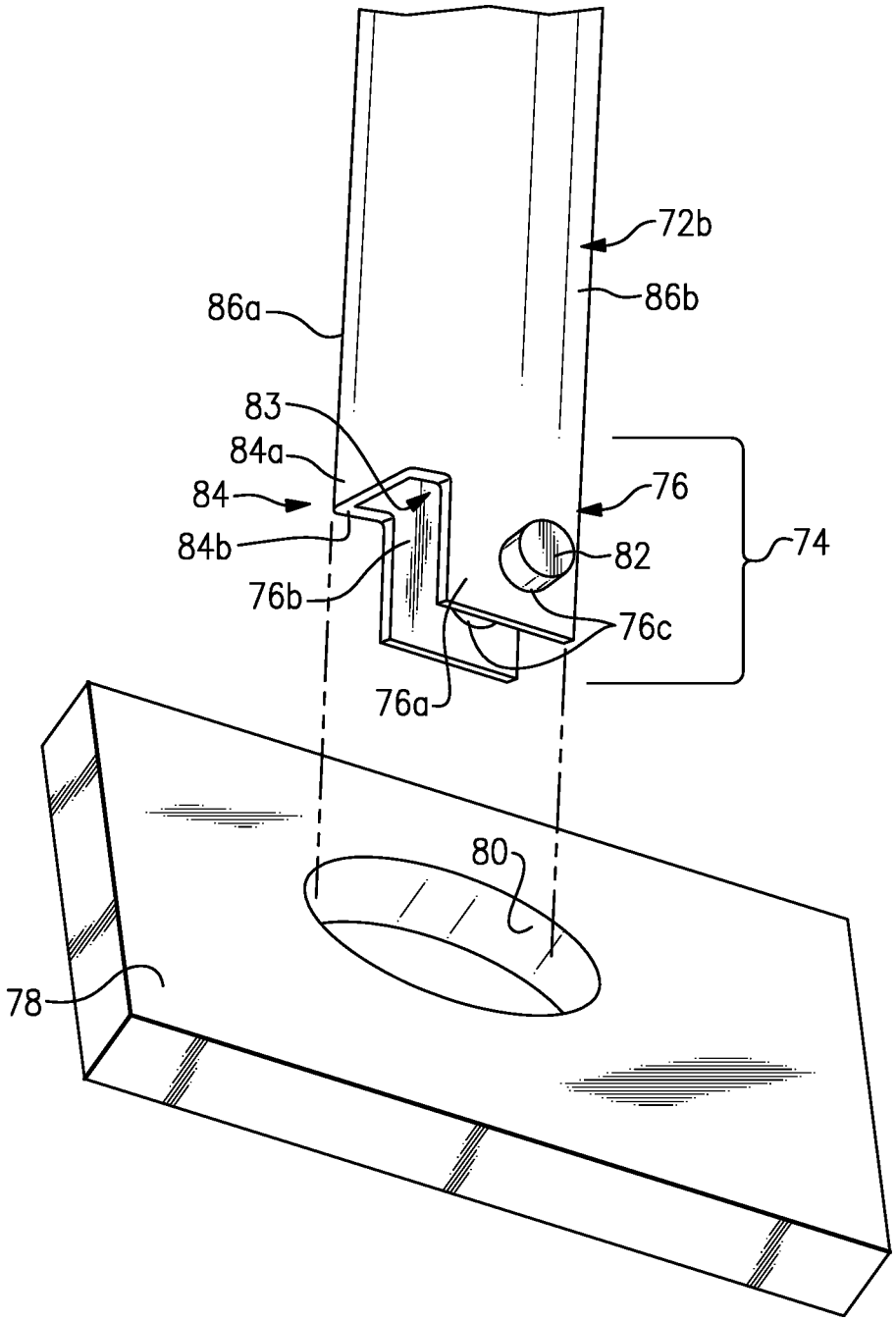
FIG. 3 illustrates a spar leg of the vane arc segment.

Referring also to the expanded view in FIG. 3 of the end portion 74 of the spar leg 72*b* and the support platform 78, the spar clevis mount 76 includes first and second prongs 76*a*/76*b* that have respective pin holes 76*c* that are coaxially aligned with each other. The pin 82 is disposed in the pin holes 76*c* (after the spar clevis mount 76 is received through the through-hole 80*a* in the support platform 78). The prongs 76*a*/76*b* are spaced apart so as to form a forked configuration. The through-passage 72*c* of the spar leg 72*b* extends between the prongs 76*a*/76*b*. The spar clevis mount 76 thus also serves as an outlet of the through-passage 72*c*. Alternatively, rather than both prongs 76*a*/76*b* having pin holes, only one of the prongs 76*a*/76*b* has a pin hole 76*c*, or the prongs 76*a*/76*b* may converge into a single prong that has a pin hole 76*c*. It is to be appreciated that a "clevis mount" as used herein refers to a fastening system in which there is at least one prong that receives a pin there through in order to fasten the support platform 78 and the spar leg 72*b* together.

The support platform 78 (FIG. 2) further includes a second through-hole 80*b*, a forward end 78*a*, and an aft end 78*b*. For reasons that will become apparent below, the second through-hole 80*b* is between the first through-hole 80*a* and the aft end 78*b*.

A baffle 84 extends through the cavity 70 (e.g., the aft sub-cavity) of the airfoil fairing 62 and through the second through-hole 80*b* of the support platform 78. The baffle 84 may be formed of, but is not limited to, a nickel-alloy, a cobalt-based superalloy, a titanium alloy, or other alloy if temperature conditions of the particular implementation permit. The baffle 84 includes impingement holes, represented at arrows 83, for emitting impingement cooling air onto the wall of the airfoil section 64.

The baffle 84 includes first and second end portions 84*a*/84*b*. The first end 84*a* is secured in a joint, represented at 86, to the support platform 78. For instance, the joint 86 may be a permanent joint that cannot be unjoined without substantial destruction of one of the components or a non-permanent joint that can readily be joined and unjoined. Whether permanent or non-permanent, the joint 86 serves to secure the baffle 84 and the support platform 78 together. The second end portion 84*b* extends through the spar platform 72*a* and may be affixed to the outer side of the spar platform 72*a* (e.g., by welding) or fixed support structure, such as an engine case.

Figure 4:
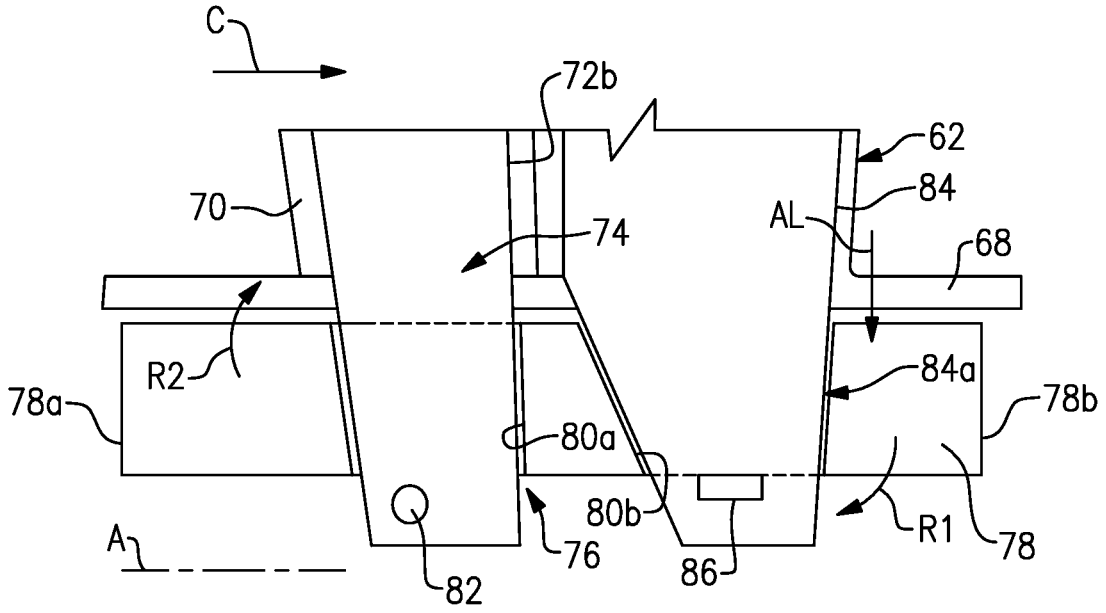
FIG. 4 illustrates a local view of an end portion of a spar leg and an end of a baffle.

FIG. 4 illustrates a local view of the end portion 74 of the spar leg 72*b*, the first end 84*a* of the baffle 84, and the support platform 78. When the engine 20 is running, flow in the core gas path C subjects the airfoil fairing 62 to aerodynamic loads. The aerodynamic loads are reacted out of the airfoil fairing 62 to the spar 72. In this example, the aerodynamic load tends to urge the airfoil fairing 62 in an aft and radially inward direction.

At least a portion of the radial component of the aerodynamic load, represented at AL, is reacted radially inwardly from the airfoil fairing 62 to the support platform 78. However, the pin 82 abuts the underside of the support platform 78 and thereby radially constrains the support platform 78. As a result, since this radial component of the aerodynamic load AL is located toward the aft end 78*a* of the support platform 78, the support platform 78 has the tendency to teeter on the pin 82 and thus rotate, as indicated at R1 (clockwise in the illustrated example). If permitted to rotate, the forward end 78*b* of the support platform 78 would tend to rotate radially outwards, as indicated at R2, and exert the load on the forward end of the platform 68 of the airfoil fairing 62. Such a load condition is undesired because it increases the stress on the airfoil fairing 62.

In order to facilitate reductions in such loads on the airfoil fairing 62, the baffle 84 serves as an anti-rotation feature and limits rotation of the support platform 78 about the pin 82. The baffle 84 is secured to the support platform 78 and affixed to the spar platform 72*a* or fixed support structure. Thus, when the support platform 78 rotates or tends to rotate, it loads the joint 86, thereby placing the baffle 84 in tension. As the spar 72 is fixed, the baffle 84 stops the support platform 78 from rotation and thereby prevents the forward end of the support platform 78 from rotating into the forward end of the platform 68. The load is thus reacted through the pin 82 to the spar leg 72*b* instead of to the platform 68 of the airfoil fairing 62. Within the available design space, the axial distance between the pin 82 and the joint 86 may be maximized in order to increase the mechanical advantage and reduce loads, while relatively shorter distances may impart relatively higher loads on the baffle 84.

It is to be appreciated that the example configuration may be adapted for other aerodynamic load conditions. For instance, if the aerodynamic load on the airfoil fairing 62 were instead reacted into the forward end of the support platform 78, the baffle 84 may instead be located forward of the spar leg 72*b*. That is, since the support platform 78 teeters about the pin 82, the baffle 84 is located on the opposite side of the pin 82 from the location at which the load is transmitted into the spar support 78. Moreover, if the aerodynamic load on the airfoil fairing 62 were instead transmitted radially outwards, the example configuration could be used in an inverted arrangement, with the spar 72 being inverted such that the spar platform 72*a* is adjacent the platform 68 and the support platform 78 is adjacent the platform 66. The baffle 84 permit the loads to be borne by the spar 72 instead of the platform 68 of the airfoil fairing 62. As a result, there may also be additional design flexibility in the positioning of the spar leg 72*b*, since the spar leg 72*b* need not be centrally located in order to balance the loads reacted out at the support platform 78. Alternatively, if space considerations do not permit positioning of the baffle 84 forward of the spar leg 72*b*, the baffle 84 could be loaded in compression.

Figure 5:
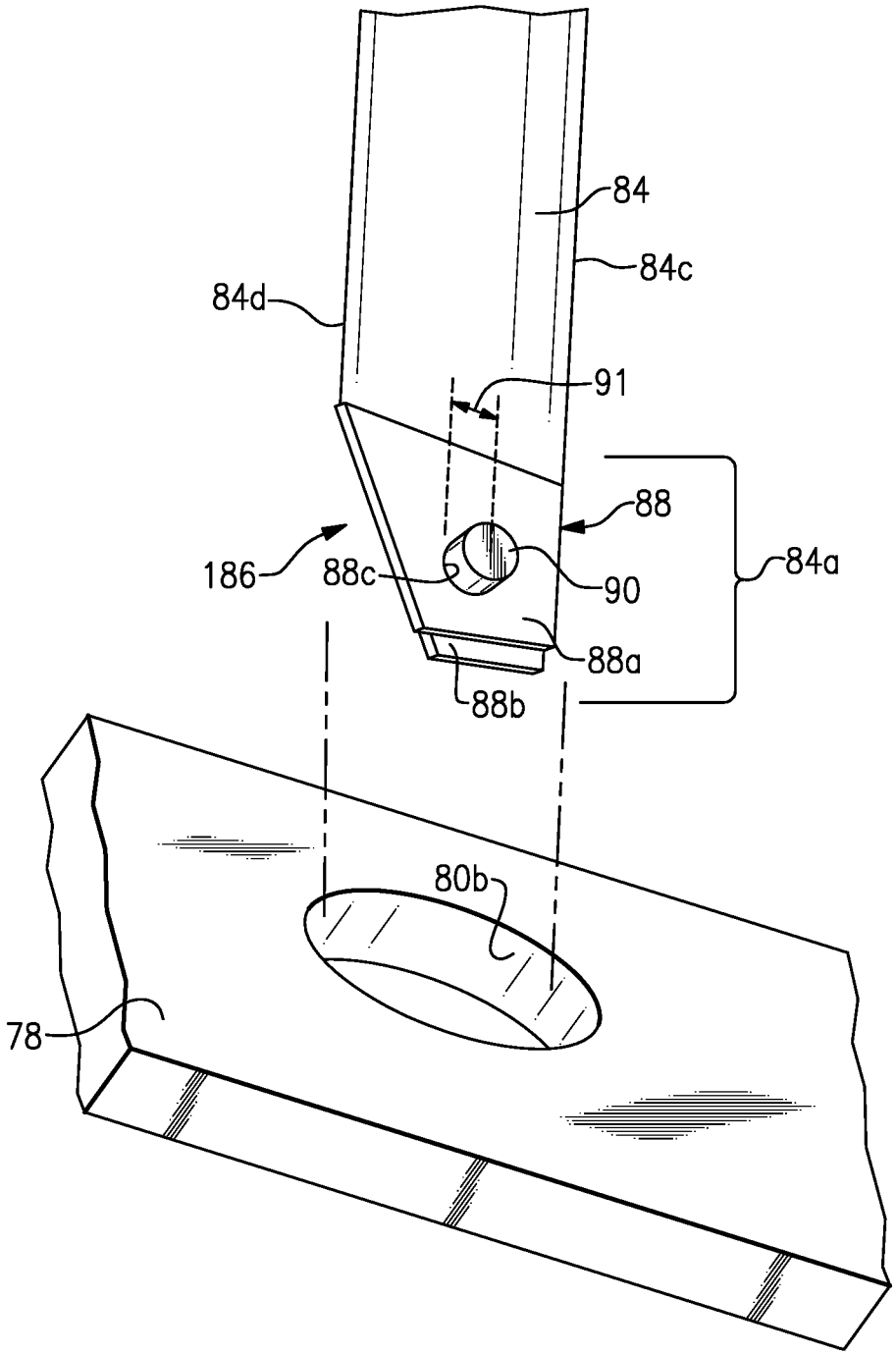
FIG. 5 illustrates an end of a baffle.

FIG. 5 illustrates an example joint 186 of the baffle 84 that may be used as described above for joint 86. The joint 186 includes a baffle clevis mount 88 on the first end portion 84*a* of the baffle 84. The baffle clevis mount 88 is configured like the spar clevis mount 76 and, like the spar clevis mount 76, will extend past the support platform 78. The baffle clevis mount 88 includes first and second prongs 88*a*/88*b* that have respective pin holes 88*c* that are coaxially aligned with each other. A pin 90 is disposed in the pin holes 88*c* (after the baffle clevis mount 88 is received through the through-hole 80*b* in the support platform 78). The prongs 88*a*/88*b* are spaced apart so as to form a forked configuration. The pin 90 is wider than the through-hole 80*b*. The ends of the pin 90 thus abut the face of the support platform 78 and thereby prevent the baffle 84 from being retracted into the through-hole 80*b*. The pin 90 thus locks the support platform 78 to the baffle 84 such that the loads are borne by the baffle 84 in tension as described above. Alternatively, rather than both prongs 88*a*/88*b* having pin holes 88*c*, only one of the prongs 88*a*/88*b* has a pin hole 88*c*, or the prongs 88*a*/88*b* may converge into a single prong that has a pin hole 88*c*.

As discussed above, within the available design space, the axial distance between the pin 82 and the joint 86 may be maximized in order to increase the mechanical advantage and reduce loads. In this regard, the pin 90 is axially offset, as represented at 91, to be nearer an aft side 84*c* of the baffle 84 than to a forward side 84*d* of the baffle 84. As will be appreciated, if the baffle 84 is forward of the spar leg 72*b* in the particular implementation, the pin 90 would then be offset to be nearer the forward side 84*d* of the baffle 84.

Figure 6:
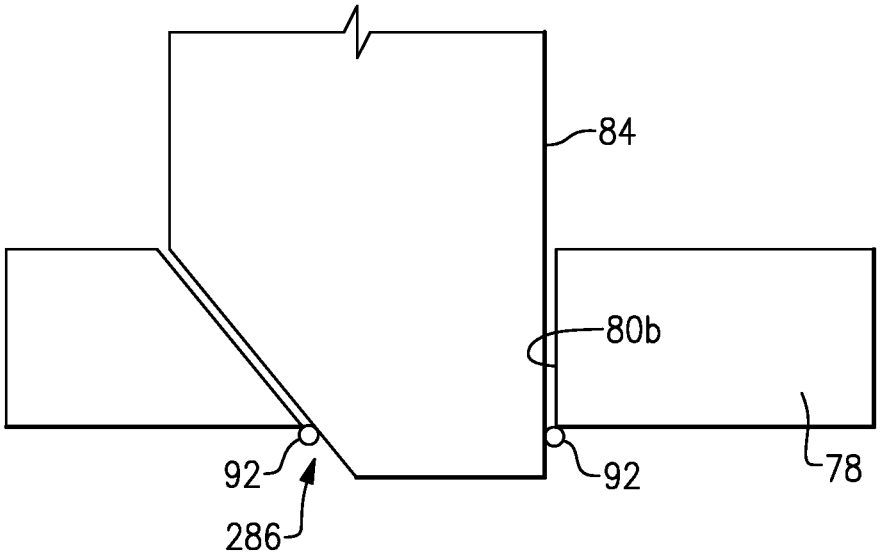
FIG. 6 illustrates an example of a joint at which a baffle is attached to a support platform.

FIG. 6 illustrates another example of a joint 286. In this example, the joint includes a weldment 92 at which the baffle 84 is welded to the support platform 78. In this regard, the alloy selected for the baffle 84 is compatible with welding, such as a nickel alloy, cobalt alloy, or titanium alloy.

Figure 7:
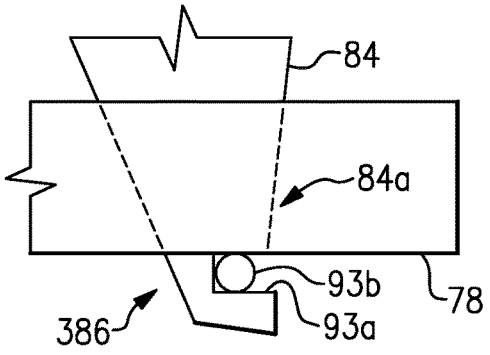
FIG. 7 illustrates another example joint that has a notch and a lock pin.
Figure 8:
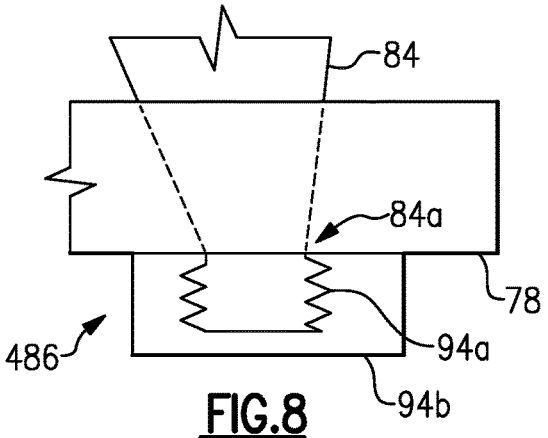
FIG. 8 illustrates another example joint that has an external thread on the baffle and a nut secured in the thread.
Figure 9:
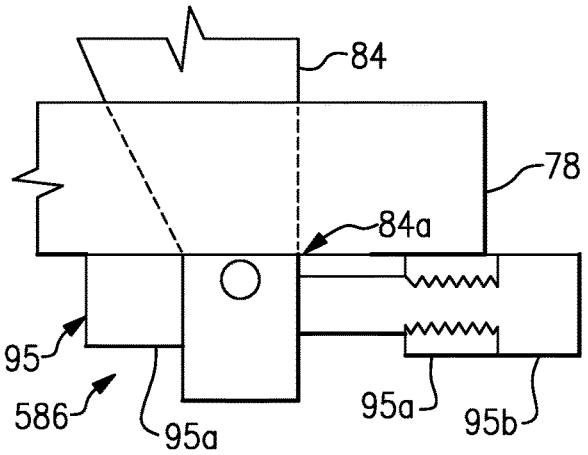
FIG. 9 illustrates another example joint that has a clamp and a set screw.
Figure 10:
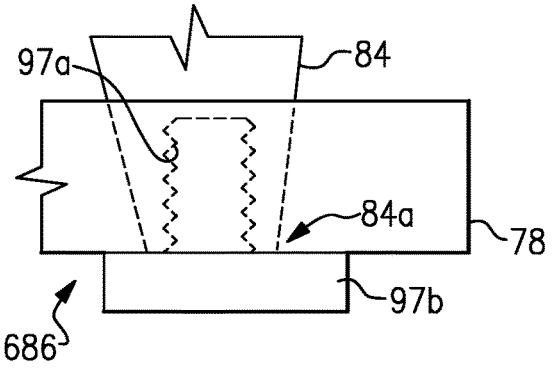
FIG. 10 illustrates another example joint that has an internal thread in the baffle and a bolt.

FIGS. 7-10 illustrate additional examples. In FIG. 7 the joint 386 includes a notch 93*a* in the end 84*a* of the baffle 84 and a lock pin 93*b* disposed in the notch 93*a*. Similar to the pin 90 of the prior example, the lock pin 93*b* prevents retraction of the baffle 84 from the support platform 78. In FIG. 8 the joint 486 includes external threads 94*a* on the end 84*a* of the baffle 84 and a nut 94*b* secured on the threads 94*a* to prevent retraction of the baffle 84 from the support platform 78. In FIG. 9 the joint 586 includes a clamp 95 that has support 95*a* and a set screw 95*b*. The set screw 96*b* is tightened against the end 84*a* of the baffle 84 to prevent retraction of the baffle 84 from the support platform 78. In FIG. 10, the joint 686 includes internal threads 97*a* in the end 84*a* of the baffle 84 and a bolt 97*b* secured in the threads 97*a* to prevent retraction of the baffle 84 from the support platform 78.

Figure 11:
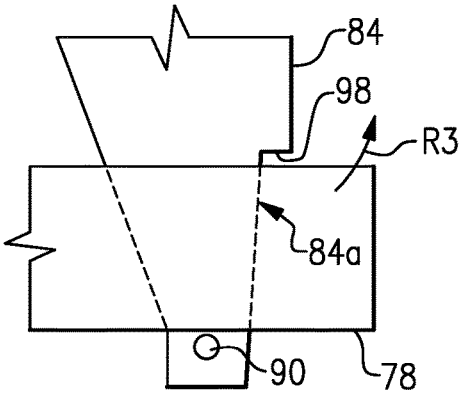
FIG. 11 illustrates a baffle that has a ledge for use in compression.

FIG. 11 illustrates an example of the baffle 84 for use in compression. Here, the baffle 84 has a ledge 98 that catches on the support platform 78. When the support platform rotates, as indicated at R3, the support platform 78 bears against the ledge 97, placing the baffle 84 in compression.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from this disclosure. The scope of legal protection given to this disclosure can only be determined by studying the following claims.

What is claimed is:

1. A vane arc segment comprising:

an airfoil fairing having first and second fairing platforms and a hollow airfoil section extending there between;

a spar having a spar platform adjacent the first fairing platform and a spar leg that extends from the spar platform and through the hollow airfoil section, the spar leg having an end portion that is distal from the spar platform and that protrudes from the second fairing platform, the end portion having a spar clevis mount;

a support platform adjacent the second fairing platform, the support platform having first and second through-holes, the end portion of the spar leg extending through the first through-hole such that the spar clevis mount protrudes from the support platform;

a spar pin extending through the spar clevis mount and locking the support platform to the spar leg such that the airfoil fairing is trapped between the spar platform and the support platform; and a baffle extending through the spar platform, through the hollow airfoil section, and through the second through-hole of the support platform, the baffle being secured in a joint to the support platform and thereby limiting rotation of the support platform about the spar pin.

2. The vane arc segment as recited in claim 1, wherein the joint includes a baffle clevis mount on an end portion of the baffle that protrudes from the support platform and a baffle pin that that extends though the baffle clevis mount.

3. The vane arc segment as recited in claim 2, wherein the baffle clevis mount includes first and second prongs that have respective pin holes that are coaxially aligned with each other, and the baffle pin is disposed in the pin holes.

4. The vane arc segment as recited in claim 3, wherein the baffle includes forward and aft sides, and the baffle pin is offset toward either the forward side or the aft side.

5. The vane arc segment as recited in claim 1, wherein the joint includes a weldment.

6. The vane arc segment as recited in claim 1, wherein the joint includes a notch on an end portion of the baffle that protrudes from the support platform and a lock pin disposed in the notch.

7. The vane arc segment as recited in claim 1, wherein the joint includes an external thread on an end portion of the baffle that protrudes from the support platform and a nut secured on the external thread.

8. The vane arc segment as recited in claim 1, wherein the joint includes a clamp that has a set screw that is tightened against the baffle.

9. The vane arc segment as recited in claim 1, wherein the joint includes an internal thread in an end portion of the baffle and a bolt secured in the internal thread.

10. The vane arc segment as recited in claim 1, wherein the baffle includes a ledge that bears against the support platform.

11. The vane arc segment as recited in claim 1, wherein the baffle is in tension.

12. The vane arc segment as recited in claim 1, wherein the airfoil fairing is formed of ceramic.

13. A gas turbine engine comprising:

a compressor section;

a combustor in fluid communication with the compressor section; and a turbine section in fluid communication with the combustor, the turbine section having vane arc segments disposed about a central axis of the gas turbine engine, each of the vane arc segments includes:

an airfoil fairing having first and second fairing platforms and a hollow airfoil section extending there between;

a spar having a spar platform adjacent the first fairing platform and a spar leg that extends from the spar platform and through the hollow airfoil section, the spar leg having an end portion that is distal from the spar platform and that protrudes from the second fairing platform, the end portion having a spar clevis mount;

a support platform adjacent the second fairing platform, the support platform having first and second through-holes, the end portion of the spar leg extending through the first through-hole such that the spar clevis mount protrudes from the support platform;

a spar pin extending through the spar clevis mount and locking the support platform to the spar leg such that the airfoil fairing is trapped between the spar platform and the support platform, the support platform having a tendency to rotate about the spar pin under the aerodynamic load received from the airfoil fairing; and a baffle extending through the spar platform, through the hollow airfoil section, and through the second through-hole of the support platform, the baffle being secured in a joint to the support platform and thereby limiting rotation of the support platform about the spar pin.

14. The gas turbine engine as recited in claim 13, wherein the joint includes a baffle clevis mount on an end portion of the baffle that protrudes from the support platform and a baffle pin that that extends though the baffle clevis mount.

15. The gas turbine engine as recited in claim 14, wherein the baffle clevis mount includes first and second prongs that have respective pin holes that are coaxially aligned with each other, and the baffle pin is disposed in the pin holes.

16. The gas turbine engine as recited in claim 15, wherein the baffle includes forward and aft sides, and the baffle pin is offset toward either the forward side or the aft side.

17. The gas turbine engine as recited in claim 13, wherein the joint includes a weldment.

18. The gas turbine engine as recited in claim 13, wherein the joint includes at least one of:

a notch on an end portion of the baffle that protrudes from the support platform and a lock pin disposed in the notch;

an external thread on an end portion of the baffle that protrudes from the support platform and a nut secured on the external thread;

a clamp that has a set screw that is tightened against the baffle; or an internal thread in an end portion of the baffle and a bolt secured in the internal thread.

19. The gas turbine engine as recited in claim 13, wherein the baffle is in tension.

20. The gas turbine engine as recited in claim 13, wherein the airfoil fairing is formed of ceramic.

* * * * *